United States Patent [19]

Delamere

[11] Patent Number: 4,611,420

[45] Date of Patent: Sep. 16, 1986

[54] SIGN CONSTRUCTION

[76] Inventor: Peter A. Delamere, 227 Balmoral Avenue, Toronto, Ontario, M4V 1K1, Canada

[21] Appl. No.: 702,802

[22] Filed: Feb. 19, 1985

[51] Int. Cl.[4] ..... G09F 15/00

[52] U.S. Cl. ..... 40/610; 40/617

[58] Field of Search ..... 40/617, 610, 612

[56] References Cited

U.S. PATENT DOCUMENTS

| | | | |
|---|---|---|---|
| 1,418,144 | 5/1922 | Fetters | 40/617 |
| 2,509,059 | 5/1950 | Hirschhorn | 40/617 |
| 2,993,465 | 7/1961 | Ginsley et al. | 40/610 |
| 3,147,560 | 9/1964 | Berger et al. | 40/610 |
| 4,059,915 | 11/1977 | Owens | 40/610 |

*Primary Examiner*—Gene Mancene
*Assistant Examiner*—Wenceslao J. Contreras
*Attorney, Agent, or Firm*—Sim & McBurney

[57] ABSTRACT

There is provided a sign which includes a plurality of panel members hinged together with split collars passing through slots in the panel members. Preferably the collars are of clear plastic. In one embodiment, each collar has an axial slit, while in a second embodiment each collar has a skewed slit in order to reduce the risk of disengagement from a panel.

8 Claims, 5 Drawing Figures

SIGN CONSTRUCTION

This invention relates generally to signs of the type used in construction, to signal detours, etc. The invention has to do particularly with a sign construction which allows a comparatively large sign (often measuring three feet square or four feet square) to be collapsed down into a much more manageable size for shipping and storage. The nature of the hinge means utilized to join the several components together is such that assembly of the various components is rapid and inexpensive.

BACKGROUND OF THIS INVENTION

Exemplary of the prior art in this area is U.S. Pat. No. 3,481,060, Hartz, issued Dec. 2, 1969.

The Hartz design incorporates a backing plate to which are attached semi-circular clips adapted to register in slots adjacent the edges of sign panels, thus holding the sign panels against the backing member. In contrast to this complex construction, requiring various panels and a backing member, it would be desirable to provide a sign construction which could dispense with any backing member, and provide the necessary rigidity simply in the sign panels themselves. At the same time, it would be desirable to utilize a plurality of such sign panels so that the sign could be folded down to a much smaller size than it occupies when fully erected.

Other prior patents of interest are as follows:

U.S. Pat. No. 3,922,998, issued Dec. 2, 1975 to May;

U.S. Pat. No. 3,256,629, issued June 21, 1966 to Whitman;

U.S. Pat. No. 2,993,465, issued July 25, 1961 to Ginsley et al;

U.S. Pat. No. 3,616,557, issued Nov. 2, 1971 to Vera.

GENERAL DESCRIPTION OF THIS INVENTION

It is an aspect of an embodiment of this invention to provide a road sign construction consisting of a plurality of individual sign panels, connected together and supported in such a way that they do not require any backing member or any large-scale panel to which they are affixed. The focus of the present invention is a sign construction which can be collapsed into a relatively narrow package, which is easily transportable and can be easily stowed in a vehicle or elsewhere.

Accordingly, this invention provides a road sign comprising:

a plurality of panel members, each having two long edges, two short edges and two opposed faces, the panel members being aligned so that a long edge of one is adjacent a long edge of another, such adjacent long edges constituting a hinge line between the respective panel members, each hinge line having at least two spaced-apart hinge members, each hinge member being a cylindrical collar having two ends and a split running from one end to the other, each hinge member being engaged through slots in the respective panel members, the slots being inwardly adjacent the respective long edges, each pair of adjacent panel members being hinged only to each other, each of the two outermost panel members having an aperture adjacent each end, a supporting X-frame having two crossed elongate frame members joined together at the middle, each frame member having adjacent its two ends a means for engaging one of said apertures, whereby the panel members are maintained in opened-out taut condition.

GENERAL DESCRIPTION OF THE DRAWINGS

Two embodiments of this invention are illustrated in the accompanying drawings, in which like numerals denote like parts throughout the several views, and in which.

DETAILED DESCRIPTION OF THE DRAWINGS

Figure 1:
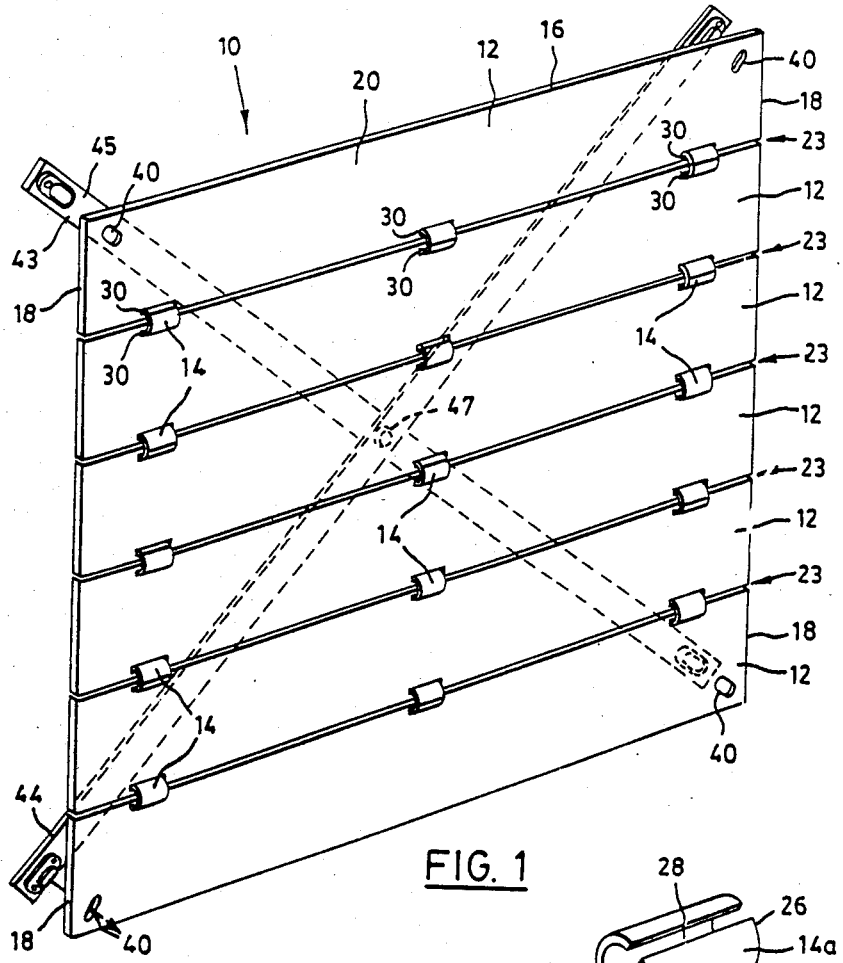
FIG. 1 is a perspective, exploded view of a road sign constructed in accordance with this invention.

Attention is first directed to FIG. 1, which shows a road sign 10 which generally comprises a plurality of panel members 12 which are hinged together with a plurality of split collars 14 passing through slots in the panel members 12. The panel members 12 are preferably of a high-strength durable plastic such as polycarbonate.

More particularly, the panel members 12 are elongated rectangles which are joined edge to edge. Each panel member 12 has two long edges 16, two short edges 18, and two opposed faces including a front face 20, and a rear face (not visible in FIG. 1). These particular parts have been marked on the upper panel 12 in FIG. 1, and it is to be understood that all panels have these various parts. As can be seen in FIG. 1, the panels 12 are aligned so that a long edge of one is adjacent a long edge of another, and these adjacent long edges between pairs of panels constitute hinge lines about which the respective panels can swing. Thus, hinge lines are defined where shown by the arrows 23 in FIG. 1.

Along each hinge line are three spaced-apart split collars, constituting hinge members.

Figure 3:
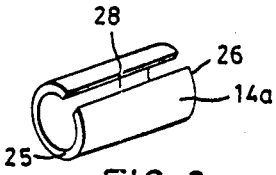

FIG. 3 shows one embodiment of a collar 14*a*, having two ends 25 and 26, and a split 28 running from one end to the other. In the embodiment illustrated in FIG. 1 and FIG. 3, each split collar is cylindrical, and the split 28 is aligned with the cylinder axis.

It is desirable, though not essential to this invention, to have the split 28 relatively narrow by comparison with the thickness of a given panel 12. In the preferred embodiment, the split 28 is narrower than the thickness of a single panel, but the material from which the collar 14*a* is constructed is resilient, preferably a resilient plastic, to allow the collar to be spread apart during assembly.

As can be seen in FIG. 1, each split collar 14 passes through aligned slots 30 in its respective panels 12, the slots 30 being aligned with the nearer long edge 16 of the respective panels 12, and being spaced inwardly a distance less than half the internal diameter of the collar 14.

Figure 2:
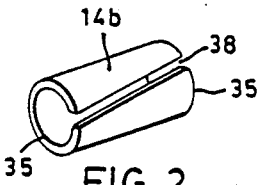
FIGS. 2 and 3 show two embodiments of a split collar for use in carrying out this invention.

Attention is now directed to FIG. 2 which shows the second embodiment of a split collar 14*b*. Again, the collar 14*b* is substantially cylindrical with two ends 33 and 35, however the split 38 is skewed with respect to the cylindrical axis. As with the first embodiment, the split 38 is preferably narrower than the width of a single panel 12, however because of the skewed nature of the split, the risk of the collar 14*b* becoming detached from one of its panels is reduced. It will be understood that, in order to release the collar 14*b* from the slot 30 of a panel, the collar 14*b* must be angled with respect to the panel, so that the split 38 becomes aligned with the main plane of the panel. This allows removal of the collar 14*b* from the panel. However, because of the angulation of the split 38 with respect to the cylindrical axis, it is not likely that the collar 14*b* would accidentally take up such required angulation at the same time that the split 38 lines up with a panel.

It is preferred that the collars 14, whether of the first or second embodiment, be of translucent plastic, such as an acrylic. By making the collars 14 of translucent plastic, they will interfere as little as possible with the reading of indicia, letters, arrows, etc. which may be marked on the panel members at the locations of the collars 14.

It is also preferred that the slots 30 be longer than the collars 14, in order to allow the individual panels 12 to flex without distorting the collars to the point of rupture.

Additionally, it is preferred that the panels 12 also be of plastic. By constructing the panels 12 and the collars 14 of plastic, the entire "indicia" portion of the sign is non-conductive, non-rusting, and light in weight.

Figure 4:
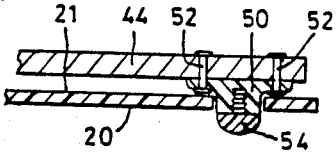
FIG. 4 is a partial sectional view taken along the line 4—4 in FIG. 1.

Turning now to FIG. 1, it is seen that the two outermost panels 12 (the upper and lower panels) are provided with apertures 40. More specifically, each of these "outside" panels 12 has an aperture 40 adjacent each end 18, these apertures 40 being intended for engagement with a supporting frame 43. The supporting frame is an X-frame which includes two crossed elongate frame members 44 and 45 which are joined together at the middle by a suitable fastening member 47 (shown in broken line in FIG. 1). Each member 44 and 45 has, adjacent its two ends, a means for engaging one of the apertures 40. Attention is directed to FIG. 4 which shows one such engaging means to consist of a flange 50 riveted to the elongate frame member 44 by rivets 52, and having an oblong, manually rotatable lock member 54. The oblong lock member 54 is adapted to pass through the corresponding aperture 40 when in a first orientation, but to be incapable of passing through the aperture 40 in an orientation at right angles to the first. Thus, in order to mount the X-frame to the assembly of panels 12, the lock members 54 are all placed in the appropriate orientation (parallel to the respective frame member), passed through the corresponding apertures 40, and then rotated through 90° to lock them into place. The locking means including the flange 50 and the locking member 54 is a well-known component, and need not be described in greater detail.

To assemble the panels 12 together, one of two methods may be utilized. The first method involves clipping the collars along the edge of a first panel, rotating each one so that the split is directed away from the panel already engaged, then slipping a second panel into place through the slits until the collars engage the appropriate slots. This operation is then repeated along the opposite edge of the second panel, and so forth until the entire assembly is completed.

It will be understood that, when using the embodiment of FIG. 2, the collar 14*b* must be angulated to some extent to allow it to engage the respective panel.

Figure 5:
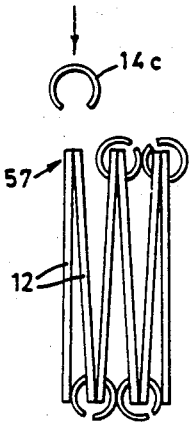
FIG. 5 is an end view of the road sign in its collapsed condition.

The other method of assembly is illustrated in FIG. 5, at the upper left. In FIG. 5, the leftward two panels 12 are almost aligned in overlying relation, with their upper edges juxtaposed as shown at the arrow 57. A collar 14*c* has been pried open so that its slit is wide enough to encompass the double thickness of two panels, and it is then slipped over the edge until it engages in the aligned slots for which it is intended.

Preferably, there are an even number of panels 12 in the sign, so that on folding, the face of the sign is folded in and cannot become scuffed during transport.

While specific embodiments of this invention have been illustrated in the accompanying drawings and described in the foregoing disclosure, it will be apparent to those skilled in the art that changes and modifications may be made therein without departing from the essence of this invention, as set forth in the appended claims.

I claim:

1. A road sign comprising:

a plurality of panel members, each having two long edges, two short edges and two opposed faces, the panel members being aligned so that a long edge of one is adjacent a long edge of another, such adjacent long edges constituting a hinge line between the respective panel members, each hinge line having at least two spaced-apart hinge members, each hinge member being a cylindrical collar having two ends and a split running from one end to the other, each hinge member being engaged through slots in the respective panel members, the slots being inwardly adjacent the respective long edges, each pair of adjacent panel members being hinged only to each other, each of the two outermost panel members having an aperture adjacent each end, a supporting X-frame having two crossed elongate frame members joined together at the middle, each frame member having adjacent its two ends a means for engaging one of said apertures, whereby the panel members are maintained in opened-out taut condition.

2. The road sign claimed in claim 1, which incorporates three hinge members spaced along each hinge line.

3. The road sign claimed in claim 1, in which each slot is longer than the length of its respective collar.

4. The road sign claimed in claim 1, in which both the panel members and the collars are of plastic material.

5. The road sign claimed in claim 1, in which the split in each collar is axial.

6. The road sign claimed in claim 1, in which the split in each collar is skewed with respect to the cylindrical axis of the collar.

7. The road sign claimed in claim 1, in which the split collar is of translucent plastic, so as to interfere as little as possible with reading the indicia on the panel members.

8. The road sign claimed in claim 7, in which the split in the collar is narrower than the thickness of a single panel.

* * * * *